US005543766A

United States Patent [19]

Bagalini

[11] Patent Number: 5,543,766

[45] Date of Patent: Aug. 6, 1996

[54] OPERATING DEVICE FOR A CIRCUIT BREAKER

[75] Inventor: Dante Bagalini, Johannesburg, South Africa

[73] Assignee: Circuit Breaker Industries Limited, Elandsfontein, South Africa

[21] Appl. No.: 353,895

[22] Filed: Dec. 12, 1994

[30] Foreign Application Priority Data

Jan. 17, 1994 [ZA] South Africa ..... 94/0315

[51] Int. Cl.[6] ..... H01H 9/00

[52] U.S. Cl. ..... 335/177; 335/242; 335/172

[58] Field of Search ..... 335/232, 177, 335/178, 179, 172–176, 78–86

[56] References Cited

U.S. PATENT DOCUMENTS 3,533,033 10/1970 Allen ..... 335/232

5,343,178 8/1994 Bagalini ..... 335/59

5,402,092 3/1995 Bagalini ..... 335/177

*Primary Examiner*—Lincoln Donovan

*Attorney, Agent, or Firm*—Ladas & Parry

[57] ABSTRACT

An electro-magnetic operating device 10 for a circuit breaker includes a coil 12 which defines a cavity 14. A pair of elements 34, 44 are slidably arranged within the cavity 14, a first element 34 being operable to cause a time delay tripping of the circuit breaker and a second element 34 being operable to cause a substantially instantaneous tripping of the circuit breaker. A first pole piece 22 is associated with the first element. A linkage 64 is carried by the second element 44 for linking the second element to a moving contact carrier 66 of the circuit breaker. A frame 18, which defines a magnetic path, is arranged about at least a part of the coil 12, the magnetic frame 18 defining a second pole piece 40 which is aligned with the first pole piece 22. The first pole piece 22 and the elements 34, 44 are displaceable towards the second pole piece 40 to effect tripping of the circuit breaker.

17 Claims, 1 Drawing Sheet

OPERATING DEVICE FOR A CIRCUIT BREAKER

BACKGROUND OF THE INVENTION

THIS INVENTION relates to an electric circuit breaker. More particularly, the invention relates to an electro-magnetic operating device for a circuit breaker.

SUMMARY OF THE INVENTION

According to the invention, there is provided an electro-magnetic operating device for a circuit breaker, the device including a coil which defines a cavity;

a pair of elements slidably arranged within the cavity, a first element being operable to cause a time delay tripping of the circuit breaker and a second element being operable to cause a substantially instantaneous tripping of the circuit breaker;

a first pole piece associated with the first element for effecting the time delay tripping of the circuit breaker;

a linkage carried by the second element for linking the second element to a moving contact carrier of the circuit breaker for effecting the substantially instantaneous tripping of the circuit breaker; and a magnetic path defining means arranged about at least a part of the coil, the magnetic path defining means defining a second pole piece which is aligned with the first pole piece, with the first pole piece and the elements being displaceable towards the second pole piece to effect tripping of the circuit breaker.

The device may include a displacing means for displacing the first pole piece and the elements away from the second pole piece.

The first element and the second element may be arranged side-by-side in the cavity, each element being in the form of a plunger. Then, the first plunger may be slidably arranged in a tube, the tube, in turn, being slidably mounted in the cavity. It will be appreciated that the tube is of a non-magnetic material such as brass or a plastics material.

One end of the tube may be closed off by an end wall with an opposed end of the tube being closed, hermetically, by the first pole piece. The first plunger may move in a damped manner in the tube to effect the time delay tripping of the circuit breaker. Thus, a damping fluid of a predetermined viscosity may be contained within the tube for damping sliding movement of the first plunger.

A first urging means, in the form of a coil spring may be arranged in the tube for urging the plunger away from the first pole piece. One end of the spring may abut against a shoulder of the first plunger with an opposed end of the spring abutting against the first pole piece.

Further, the device may include a second urging means for urging the second plunger away from the second pole piece.

The magnetic path defining means may comprise a metal frame, a part of which defines the second pole piece, the frame including a member arranged in spaced, parallel relationship to the second pole piece.

The frame may be substantially "U"-shaped with a pair of opposed limbs and a bridging portion interconnecting the limbs. The bridging portion may define the second pole piece. The member may be arranged in parallel, spaced relationship to the bridging portion, the member extending between the limbs.

The device may include a mounting means mounted on the member of the frame, the coil being carried on the mounting means. The mounting means may be in the form of a bobbin.

The tube may be slidably mounted in a first passage of the bobbin and the second plunger may be slidably arranged in a second passage of the bobbin.

That end of the bobbin closer to the second pole piece may define a bearing surface against which a first end of the second urging means, which may also be in the form of a coil spring, abuts. An opposed end of the coil spring may then abut against a shoulder of said second plunger for urging the second plunger away from the second pole piece.

An end of the second plunger may protrude through an opening in the member of the frame, said end of the plunger carrying the linkage thereon. The linkage may be a lost-motion linkage.

Thus, the moving contact carrier can move independently of the second plunger and the second plunger can, to a predetermined extent, move independently of the moving contact carrier. The moving contact carrier may be displaceable between an "on" position in which an electrical path of the circuit breaker is closed and an "off" position in which the electrical path is open. The lost-motion operation of the linkage may then be such that the second plunger may move from its first position towards the second pole piece without moving the moving contact carrier when the moving contact carrier is in its "on" position; and the moving contact carrier may move from its "on" position towards its "off" position without displacing the second plunger when the second plunger is in its first position.

Those skilled in the art will readily appreciate that, due to the damped motion of the first plunger and the proximity of the first plunger to the first pole piece, the first plunger will serve as a time delay trip mechanism for the circuit breaker under moderate overload conditions. Further, the second plunger will serve to trip the circuit breaker in a substantially instantaneous manner under higher overload conditions such as a short circuit condition.

The displacing means may comprise a pair of displacing members, or pins, one associated with each plunger. A first pin, associated with the first plunger, may be shorter in length than a second pin, associated with the second plunger.

The pins may protrude through apertures in the second pole piece to co-operate with a trip component, such as a trip bar, of a trip mechanism of the circuit breaker. The first pin may act on the first pole piece and the second pin may act on the second plunger.

Further, it will be appreciated that, with the assembly of the device, the need for an armature which is magnetically attracted to a pole piece to operate a trip mechanism of the circuit breaker is obviated.

The invention extends also to a circuit breaker which includes an electro-magnetically operable device as described above.

The circuit breaker may then have the trip bar which is displaced by the first pin or the second pin, as the case may be, upon movement of the first plunger (and, hence, the first pole piece) or the second plunger, respectively, the trip bar then interacting with a trip mechanism of the circuit breaker.

The invention is now described by way of example with reference to the accompanying diagrammatic drawings.

DETAILED DESCRIPTION OF DRAWINGS

Figure 1:
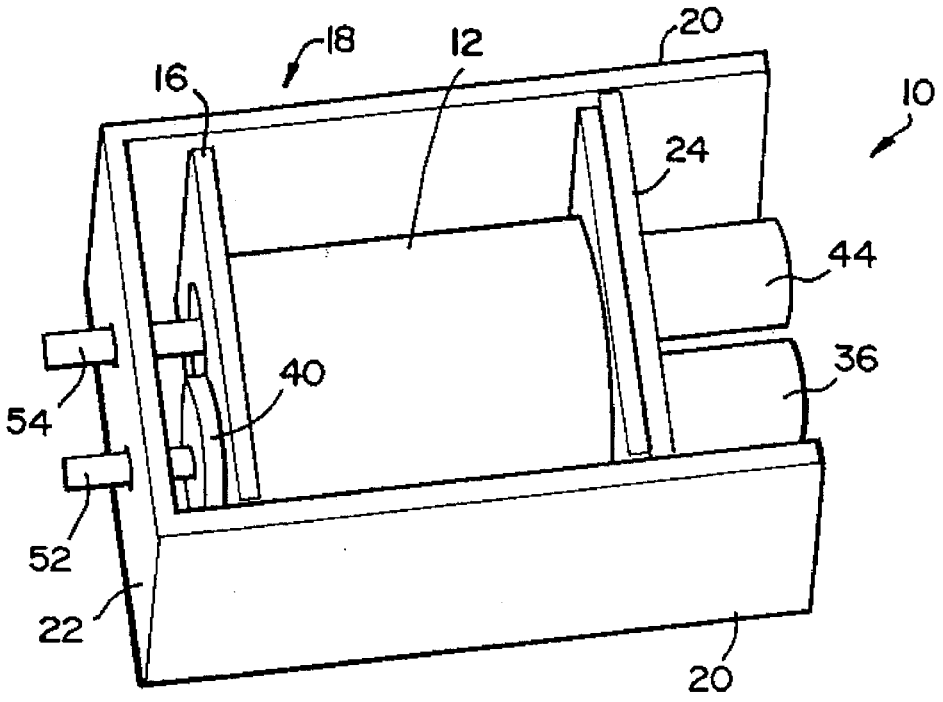
FIG. 1 shows a schematic, three dimensional view of an electro-magnetic operating device, in accordance with the invention, for a circuit breaker.

Referring to the drawings, an electro-magnetic operating device, in accordance with the invention, for a circuit breaker is illustrated and is designated generally by the reference numeral 10. The operating device 10 comprises a coil 12 which defines a cavity 14.

The coil 12 is carried on a bobbin 16 of a non-magnetic material. The bobbin 16 is arranged within a magnetic path defining means in the form of a metal frame 18. The frame 18 is substantially "U"-shaped and has a pair of opposed limbs 20 interconnected by a bridging portion 22. The frame 18 further includes a member 24 which extends between the limbs 20 in spaced parallel relationship to the bridging portion 22. The bobbin 16 is carried on the member 24 within the frame 18.

The bobbin 16 defines a pair of passages 26, 28 therein. The passage 26 is in alignment with an opening 30 in the member 24. Similarly, the passage 28 is in register with an opening 32 defined in the member 24.

A first plunger 34, housed within a tube 36, is arranged within the passage 26. The first plunger 34 is slidably arranged within the housing 36 and a damping fluid, of a predetermined viscosity, is contained within the housing 36 for damping sliding movement of the first plunger 34 within the housing 36.

An urging means in the form of a coil spring 38 is contained within the housing 36 for urging the plunger 34 to the position shown in FIG. 2 of the drawings under normal operating conditions of the circuit breaker, as will be described in greater detail below.

The housing 36 is closed off by an end wall at that end protruding through the opening 30 in the member 24 of the frame 18. An opposed end of the housing 36, closer to the bridging portion 22 of the frame 18, is closed off in a hermetic manner by a metal cap which defines a first pole piece 40. One end of the coil spring 38 abuts against the pole piece 40 and an opposed end of the spring bears against a shoulder of the plunger 34, the coil spring 38 being received over a narrower region 42 of the plunger 34.

A second plunger 44 is slidably arranged in the passage 28 of the bobbin 16. The plunger 44 protrudes through the opening 32 in the member 24 of the frame 18 and is urged into this position by an urging means, also in the form of a coil spring 46. One end of the coil spring 46 abuts against a bearing surface 49 defined by the bobbin 16 with an opposed end of the spring 46 bearing against a shoulder of the plunger 44, the spring 46 being received over a narrower region 48 of the plunger 44.

It is to be noted that the bridging portion 22 serves as a second pole piece of the operating device 10, as will be described in greater detail below.

Figure 2:
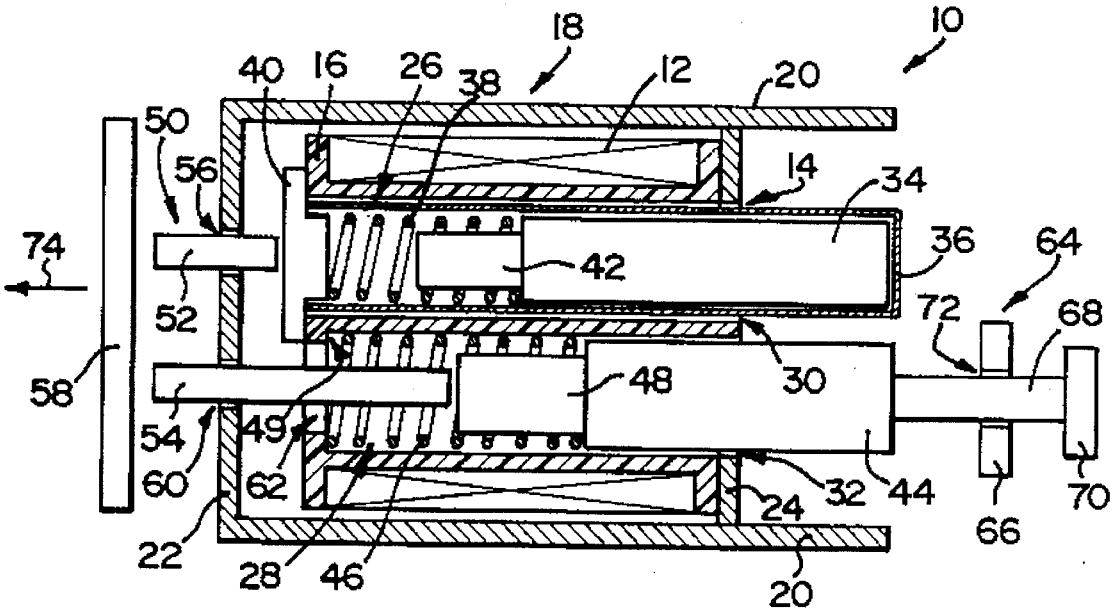
FIG. 2 shows a sectional side view of the operating device.

The operating device 10 includes a displacing means 50 for displacing the first plunger 34 and housing 36 and the second plunger 44 to the position shown in FIG. 2 of the drawings. The displacing means 50 includes a pair of spaced pins 52, 54. The pin 52 extends through an aperture 56 in the second pole piece 22 of the frame 18. One end of the pin 52 abuts against the first pole piece 40 and the other end of the pin 52 is arranged in proximity to a component, in the form of a trip bar 58, of a trip mechanism (not shown), of the circuit breaker.

The other pin 54 extends through a second aperture 60 in the second pole piece 22 of the frame 18 and through an aperture 62 in the bobbin 16 in register with the second passage 28 of the bobbin 16 such that one end of the pin 54 bears against that end of the plunger 44 within the passage 28. Once again an opposed end of the pin 54 terminates in proximity to the trip bar 58 of the trip mechanism of the circuit breaker.

A lost-motion linkage 64 is carried on that end of the plunger 44 protruding through the opening 32 in the member 24 of the frame 18. The linkage 64 is omitted from FIG. 1 for the sake of clarity.

The linkage 64 mechanically links the second plunger 44 to a moving contact carrier 66 of the circuit breaker. The linkage 64 operates on a lost-motion basis such that the moving contact carrier 66 can move independently of the second plunger 44 and the second plunger 44 can, to a predetermined extent, move independently of the moving contact carrier 66. In this regard, it will be appreciated that the moving contact carrier 66 is displaceable between an "on" position in which an electrical path of the circuit breaker is closed and an "off" position in which the electrical path is open.

The linkage 64 comprises an elongate element 68 projecting from the plunger 44 with a T-piece 70 being secured to a free end of the element 68. The elongate element 68 projects through an opening 72 in the moving contact carrier 66. The length of the element 68 between the end of the plunger 44 and the T-piece 70 is such that when the moving contact carrier is in its closed or "on" position and the second plunger 44 is in its rest position (as shown in FIG. 2), the moving contact carrier 66 is substantially centrally located along the length of the element 68. Thus, with the second plunger 44 in its rest position, the moving contact carrier 66 is free to move on the elongate element 68 from its closed or "on" position to an open or "off" position.

Further, when the moving contact carrier 66 is in its "on" or closed position, the second plunger 44 can move, to a predetermined extent, towards the second pole piece 22 of the operating device 10 without displacing the moving contact carrier 66.

It will be appreciated that the coil 12 carries the load current of the circuit breaker.

Hence, in use, if the coil 12 carries a current below the rated value of the circuit breaker, the plungers 34 and 44 and the housing 36 are in the position shown in FIG. 2 of the drawings. Further, the plungers 34 and 44 do not experience a magnetic force sufficient to displace them against the action of the springs 38 and 46 respectively.

Under a moderate overload condition, the plunger 34 moves towards the first pole piece 40 with a speed which is determined by the magnitude of the current, the viscosity of the damping fluid contained within the housing 36 and the spring force of the spring 38. The spring force of the spring 46 acting on the plunger 44 is sufficiently large to inhibit movement of the plunger 44 from the position shown in FIG. 2 of the drawings.

When the gap between the first pole piece 40 and the plunger 34 is completely closed, the first pole piece 40 is attracted to the second pole piece 22. Attraction of the first pole piece 40 towards the second pole piece 22 causes the pin 52 to move into abutment with the trip bar 58, displacing the trip bar 58 in the direction of arrow 74. This causes operation of the trip mechanism of the circuit breaker to trip the circuit breaker with a time delay.

In a short circuit situation, the forces acting on the plungers 34 and 44 and the first pole piece 40 are much greater than the spring forces exerted on the plungers 34 and 44 by the springs 38 and 46.

Hence, the first pole piece 40 is attracted to the second pole piece 22 and the plunger 44 is accelerated towards the second pole piece 22 against the action of the spring 46. The first pole piece 40 impinges on the pin 52 and the plunger 44 impinges on the pin 54 causing displacement of the trip bar 58 in the direction of the arrow 74 thereby causing tripping of the circuit breaker. This occurs even before the plunger 34 starts moving towards the first pole piece 40 such that tripping of the circuit breaker is effected in a substantially instantaneous manner.

Further, as the plunger 44 is accelerated towards the second pole piece 22, the elongate element 68 is also displaced in the direction of the arrow 74. The length of the element 68 is such that, before the plunger 44 has reached the limit of its travel, the T-piece 70 engages the moving contact carrier 66 causing the moving contact carrier 66 to be moved rapidly away from a fixed contact (not shown) of the circuit breaker. The high opening speed of the moving contact carrier 66, when there is a large overload current, introduces a high resistance to the electric circuit limiting the let-through current and reducing the clearing time of the circuit breaker.

To reset the trip bar 58, the trip mechanism of the circuit breaker includes an urging means (not shown). The urging means, which may be in the form of a compression spring, acts on the trip mechanism and, in turn, the trip bar 58 to cause the trip bar 58 to be returned to the position shown in FIG. 2 of the drawings.

It is a particular advantage of the invention, that the design of the operating device 10 obviates the need for a pivotal, electro-magnetically attracted armature thereby simplifying manufacture of the circuit breaker and reducing the cost thereof. Furthermore, the circuit breaker provides a greater electro-magnetic force, at the same current, than prior art devices using pivotal armatures. Also, the arrangement of the linkage 64 minimises the possibility of contact welding during overloads.

I claim:

1. An electro-magnetic operating device for a circuit breaker, the device including:

a coil which defines a cavity;

a pair of elements slidably arranged within the cavity, a first element being operable to cause a time delay tripping of the circuit breaker and a second element being operable to cause a substantially instantaneous tripping of the circuit breaker;

a first pole piece associated with the first element for effecting the time delay tripping of the circuit breaker;

a linkage carried by the second element for linking the second element to a moving contact carrier of the circuit breaker for effecting the substantially instantaneous tripping of the circuit breaker; and a magnetic path defining means arranged about at least a part of the coil, the magnetic path defining means defining a second pole piece which is aligned with the first pole piece, with the first element being displaceable towards the first pole piece in a damped manner and the first pole piece being displaceable towards the second pole piece to effect the time delay tripping of the circuit breaker and the first pole piece and the second element being displaceable towards the second pole piece to effect the substantially instantaneous tripping of the circuit breaker.

2. The device as claimed in claim 1 which includes a displacing means for displacing the first pole piece and the elements away from the second pole piece.

3. The device as claimed in claim 2 in which the first element and the second element are arranged side-by-side in the cavity, each element being in the form of a plunger.

4. The device as claimed in claim 3 in which the first plunger is slidably arranged in a tube, the tube, in turn, being slidably mounted in the cavity.

5. The device as claimed in claim 4 in which one end of the tube is closed off by an end wall with an opposed end of the tube being closed, hermetically, by the first pole piece.

6. The device as claimed in claim 5 in which a damping fluid is contained within the tube for damping sliding movement of the first plunger.

7. The device as claimed in claim 6 in which a first urging means is arranged in the tube for urging the plunger away from the first pole piece.

8. The device as claimed in claim 7 which includes a second urging means for urging the second plunger away from the second pole piece.

9. The device as claimed in claim 4 in which the magnetic path defining means comprises a metal frame, a part of which defines the second pole piece, the frame including a member arranged in spaced, parallel relationship to the second pole piece.

10. The device as claimed in claim 9 which includes a mounting means mounted on the member of the frame, the coil being carried on the mounting means.

11. The device as claimed in claim 10 in which the tube is slidably mounted in a first passage of the mounting means and the second plunger is slidably arranged in a second passage of the mounting means.

12. The device as claimed in claim 11 in which an end of the second plunger protrudes through an opening in the member of the frame, said end of the plunger carrying the linkage thereon.

13. The device as claimed in claim 12 in which the linkage is a lost-motion linkage.

14. The device as claimed in claim 3 in which the displacing means comprises a pair of displacing members, one associated with each plunger.

15. The device as claimed in claim 14 in which a first displacing member, associated with the first plunger, is shorter in length than a second displacing member, associated with the second plunger.

16. The device as claimed in claim 15 in which the displacing members protrude through apertures in the second pole piece to co-operate with a trip component of a trip mechanism of the circuit breaker.

17. The device as claimed in claim 16 in which the first displacing member acts on the first pole piece and the second displacing member acts on the second plunger.

* * * * *